US012108812B2

(12) United States Patent
Allen

(10) Patent No.: US 12,108,812 B2
(45) **Date of Patent: *Oct. 8, 2024**

(54) BUTTOCKS SUPPORT DEVICE AND METHODS RELATED THERETO

(71) Applicant: Darlene Allen, Jonesboro, GA (US)

(72) Inventor: Darlene Allen, Jonesboro, GA (US)

( * ) Notice: Subject to any disclaimer, the term of this patent is extended or adjusted under 35 U.S.C. 154(b) by 26 days.

This patent is subject to a terminal disclaimer.

(21) Appl. No.: 18/080,694

(22) Filed: Dec. 13, 2022

(65) Prior Publication Data

US 2023/0116765 A1 Apr. 13, 2023

Related U.S. Application Data

(63) Continuation of application No. 14/996,707, filed on Jan. 15, 2016, now Pat. No. 11,553,738.

(60) Provisional application No. 62/125,149, filed on Jan. 15, 2015.

(51) Int. Cl.
*A41C 1/00* (2006.01)
*A41C 5/00* (2006.01)

(52) U.S. Cl.
CPC ..... *A41C 1/003* (2013.01); *A41C 5/00* (2013.01)

(58) Field of Classification Search
CPC ..... A61F 13/148; A41C 1/003
See application file for complete search history.

(56) References Cited

U.S. PATENT DOCUMENTS

| | | | | |
|---|---|---|---|---|
| 1,599,638 | A | 9/1926 | Buchannan | |
| 3,091,238 | A | 5/1963 | De Bogory | |
| 3,880,160 | A | 4/1975 | Hall | |
| 4,926,845 | A | 5/1990 | Harris | |
| 5,729,835 | A | 3/1998 | Williams | |
| 5,893,367 | A | 4/1999 | Dubats et al. | |
| 6,058,514 | A | 5/2000 | Hart | |
| 6,308,338 | B1 | 10/2001 | Caldwell | |
| 7,081,036 | B1 | 7/2006 | Howard et al. | |
| 7,404,216 | B1 | 7/2008 | Paramore | |
| 11,553,738 | B1 * | 1/2023 | Allen | A41C 1/003 |
| 2005/0121040 | A1 | 6/2005 | Franklin | |
| 2005/0211739 | A1 | 9/2005 | Bayless | |
| 2006/0229175 | A1 | 10/2006 | Frappier | |

OTHER PUBLICATIONS

U.S. Appl. No. 62/125,149, filed Jan. 15, 2015, Darlene Allen.
U.S. Appl. No. 14/996,707, filed Jan. 15, 2016, Darlene Allen.

* cited by examiner

*Primary Examiner* — Gloria M Hale
(74) *Attorney, Agent, or Firm* — Ballard Spahr LLP

(57) ABSTRACT

This disclosure relates to a buttocks support garment that cannot be seen through clothing and that provides a natural-looking, lifted buttocks, and methods related thereto. This abstract is intended as a scanning tool for purposes of searching in the particular art and is not intended to be limiting of the present disclosure.

20 Claims, 7 Drawing Sheets

BUTTOCKS SUPPORT DEVICE AND METHODS RELATED THERETO

CROSS-REFERENCE TO RELATED APPLICATIONS

This application is a Continuation of U.S. application Ser. No. 14/996,707, filed on Jan. 15, 2016, now issued as U.S. Pat. No. 11,553,738, which claims the benefit of U.S. Provisional Application No. 62/125,149, filed on Jan. 15, 2015, which is incorporated herein fully by reference in its entirety.

BACKGROUND

Obsession with visual appearance has become commonplace in modern society and has resulted in an upswing in cosmetic procedures. Buttocks augmentation surgery uses implants, fat grafting, or a combination of both to increase the fullness, roundness, and projection of the buttocks. Unfortunately, this procedure is costly, generally costing upwards of $4,000, and thus unavailable to a large percentage of consumers. Additionally, the recovery process for buttocks augmentation typically lasts three to four weeks, including a time period of up to three weeks in which the patient may be told to refrain from sitting on his or her buttocks.

The traditional approach to improving the appearance of one's backside (buttocks area) is diet and exercise. It is well established that workout regimes including squats, lunges, step-ups, and hip extensions, together with a healthy eating routine can improve the strength and shape of the buttocks. However, these techniques require that an individual consistently maintain these activities for months, and even years, in order to see any results. The rate and quality of the results achieved also vary significantly with age (older longer than younger), gender (female longer than male), and body type. Moreover, fat cells that have been deposited around the hips and thighs are known to be less responsive than in other parts of the body, making improvements to the buttocks area even more trying.

In order to overcome these challenges, a variety of undergarments have been developed (e.g., Spanx®, buttocks pads, and padded underwear). Unfortunately, these garments are often uncomfortable, produce an unnatural look and/or feel, and can be seen through the clothes. Accordingly, there remains a need for a cost efficient undergarment that provides a natural-looking, lifted buttocks. These needs and others are met by the present disclosure.

SUMMARY

In accordance with the purpose(s) of the disclosure, as embodied and broadly described herein, the disclosure, in an aspect, relates to garments that support and lift a wearer's buttocks and methods of making same.

Disclosed are garments comprising: (a) an abdominal member adapted to encircle a portion of a person's abdomen; (b) a first thigh member and a second thigh member, wherein each thigh member is adapted to encircle a person's thigh; (c) a first support member comprising a first end attached to the first thigh member and an opposed second end attached to a first location on the abdominal member; and (d) a second support member comprising a first end attached to the second thigh member and an opposed second end attached to a second location on the abdominal member, wherein, in use, the first support member is substantially parallel to the second support member.

Also disclosed are methods of lifting a person's buttocks, the method comprising wearing a disclosed buttocks support garment, thereby lifting the person's buttocks.

Also disclosed are methods of making a buttocks support garment, the method comprising: (a) attaching a first end of a first support member and a first thigh member, wherein the first thigh member is adapted to encircle a person's thigh; (b) attaching a first end of a second support member and a second thigh member, wherein the second thigh member is adapted to encircle a person's thigh; (c) attaching a second end of the first support member to a first location on an abdominal member, wherein the abdominal member is adapted to encircle a person's abdomen; and (d) attaching a second end of the second support member to a second location on the abdominal member, wherein, in use, the first support member is substantially parallel to the second support member, thereby making a buttocks support garment.

Also disclosed are kits comprising a disclosed buttocks support garment and one or more of: (a) instructions for attaching an abdominal member and a support member; (b) instructions for attaching a thigh member and a support member; or (c) instructions for lifting a buttocks.

Also disclosed are kits comprising: a buttocks support garment comprising (a) an abdominal member adapted to encircle a person's abdomen; (b) a first thigh member and a second thigh member, wherein each thigh member is adapted to encircle a person's thigh; (c) a first support member and a second support member, wherein each support member comprises a first end and an opposed second end; (d) and one or more of: (e) instructions for attaching an abdominal member and a support member; (f) instructions for attaching a thigh member and a support member; or (g) instructions for lifting a buttocks.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the disclosure.

Figure 1A:
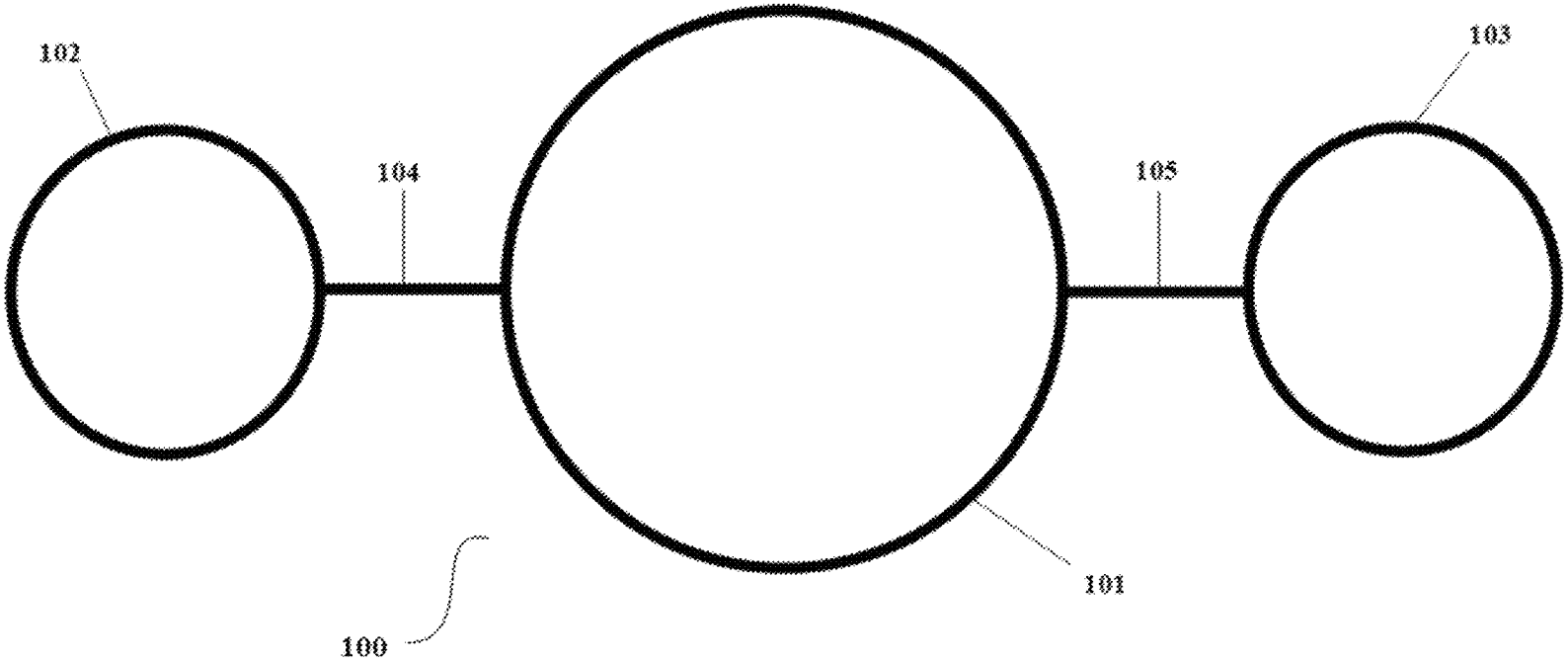
FIG. 1A and FIG. 1B show representative images of a buttocks support device having support members attached to the abdominal member at a position about 180° apart. A top view (1A) and a front view (1B) are shown.

Additional advantages of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DESCRIPTION

The present disclosure can be understood more readily by reference to the following detailed description of the disclosure and the Examples and Figures included herein.

While aspects of the present disclosure can be described and claimed in a particular statutory class, such as the article of manufacture statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior disclosure. Further, the dates of publication provided herein may be different from the actual publication dates, which can require independent confirmation.

A. Definitions

As used in the specification and the appended claims, the singular forms "a," "an" and "the" include plural referents unless the context clearly dictates otherwise. Thus, for example, reference to "a liner," "a harness," or "a car seat" includes mixtures of two or more such liners, harnesses, or car seats, and the like.

As used herein, the terms "optional" or "optionally" means that the subsequently described event or circumstance can or cannot occur, and that the description includes instances where said event or circumstance occurs and instances where it does not.

As used herein, the term "adjustment member" refers to a fastener that can be manipulated by a person in order to adjust the size of a buttocks support garment. Examples of adjustment members include, but are not limited to, clasps, buckles, and hook-and-loop fasteners.

As used herein, the term "attachment member" refers to a fastener by which a member (e.g., the abdominal member, the thigh member, and/or the support member) may be attached to another component, for example, a stocking. Examples of attachment members include, but are not limited to, straps, loops, hooks, clasps, clips, and snaps.

As used herein, "comprising" is to be interpreted as specifying the presence of the stated features, integers, steps, or components as referred to, but does not preclude the presence or addition of one or more features, integers, steps, or components, or groups thereof. Additionally, the term "comprising" is intended to include examples encompassed by the term "consisting of."

B. Buttocks Support Garments

In an aspect, disclosed are garments comprising: (a) an abdominal member adapted to encircle a portion of a person's abdomen; (b) a first thigh member and a second thigh member, wherein each thigh member is adapted to encircle a person's thigh; (c) a first support member comprising a first end attached to the first thigh member and an opposed second end attached to a first location on the abdominal member; and (d) a second support member comprising a second end attached to the second thigh member and an opposed second end attached to a second location on the abdominal member, wherein, in use, the first support member is substantially parallel to the second support member.

Figure 1B:
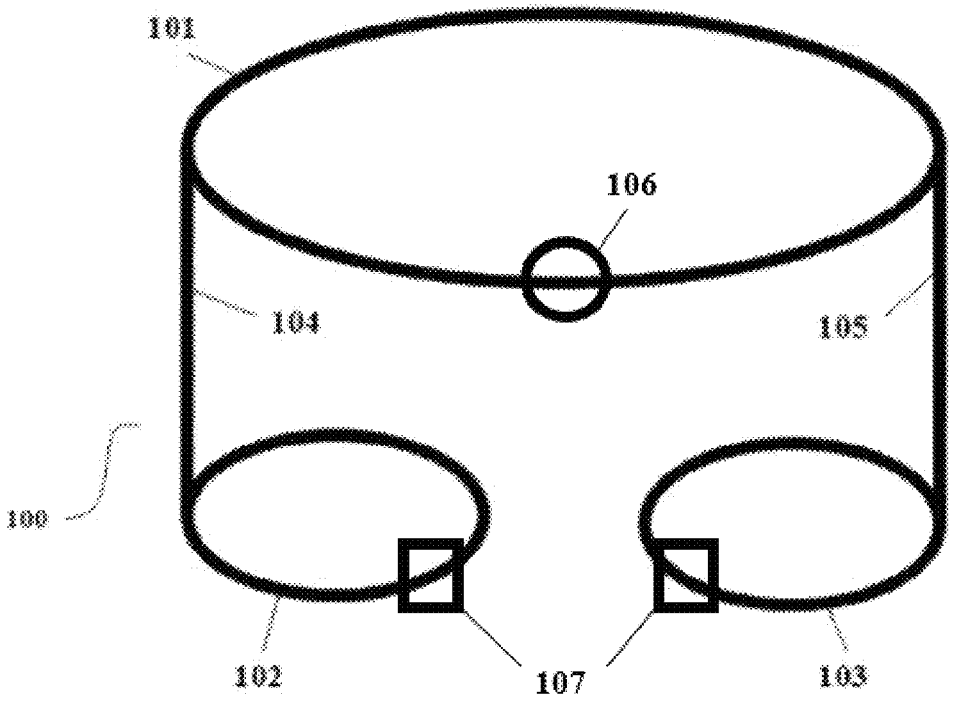

Referring to FIG. 1A and FIG. 1B, for example, buttocks support garment 100 comprises abdominal member 101, first thigh member 102, second thigh member 103, first support member 104, and second support member 105. In an aspect, thigh member 102 and thigh member 103 are identical in width, length, and shape. In an aspect, thigh member 102 and thigh member 103 are not identical in width, length, and shape. In an aspect, support member 104 and support member 105 are identical in width, length, and shape. In an aspect, support member 104 and support member 105 are not identical in width, length, and shape. FIG. 1A shows a top view of buttocks support garment 100, in which support members 104 and 105 are in the same plane as abdominal member 101. FIG. 1B shows a side view of buttocks support garment 100, in which support members 104 and 105 are perpendicular to the plane in which abdominal member 101 is located, as in use. As shown here, support member 104 is attached at one end to thigh member 102 and the opposing end of support member 104 is attached to abdominal member 101. Support member 105 is attached at one end to the thigh member 103 and the opposing end of support member 104 is attached to abdominal member 101. The position on abdominal member 101 at which support member 104 is attached is located approximately 180° from the position on abdominal member 101 at which support member 105 is attached, although other degrees of separation between the attachment locations of support members 104 and 105 are also envisioned. For example, support member 104 could be attached to abdominal member 101 and separated from the attachment location of support member 105 on abdominal member 101 from about 180° to about 0°, i.e., attachment locations adjacent to each other, and all ranges therein between. Thus, in an aspect, the attachment location of support member 104 is approximately 180° from the attachment location of support member 105. In an aspect, the attachment location of support member 104 is approximately 150° from the attachment location of support member 105. In an aspect, the attachment location of support member 104 is approximately 120° from the attachment location of support member 105. In an aspect, the attachment location of support member 104 is approximately 90° from the attachment location of support member 105. In an aspect, the attachment location of support member 104 is approximately 60° from the attachment location of support member 105. In an aspect, the attachment location of support member 104 is approximately 30° from the attachment location of support member 105.

Figure 2A:
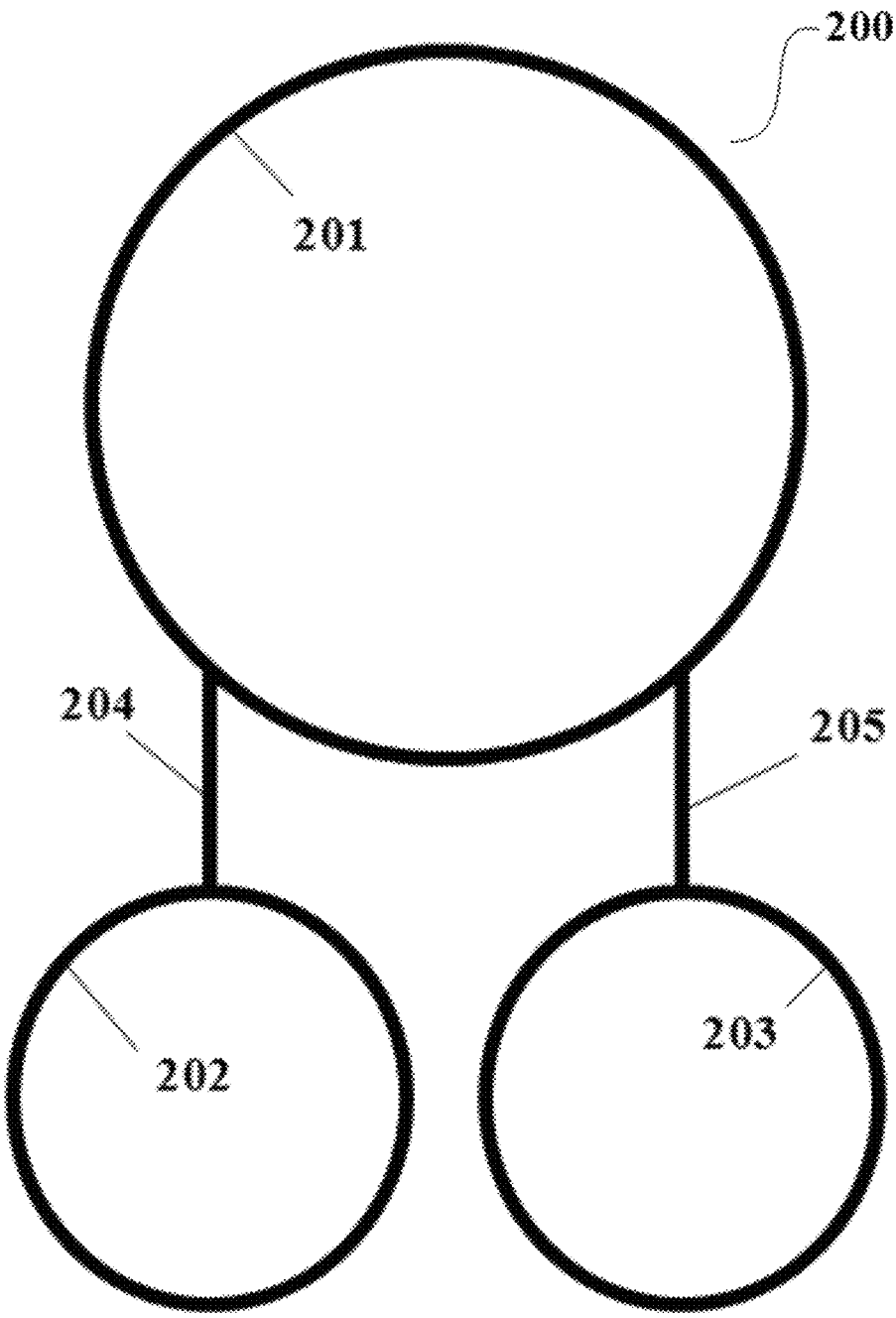
FIG. 2A and FIG. 2B show representative images of a buttocks support device having support members attached to the abdominal member at a position about 30° apart. A top view (2A) and a front view (2B) are shown.
Figure 2B:
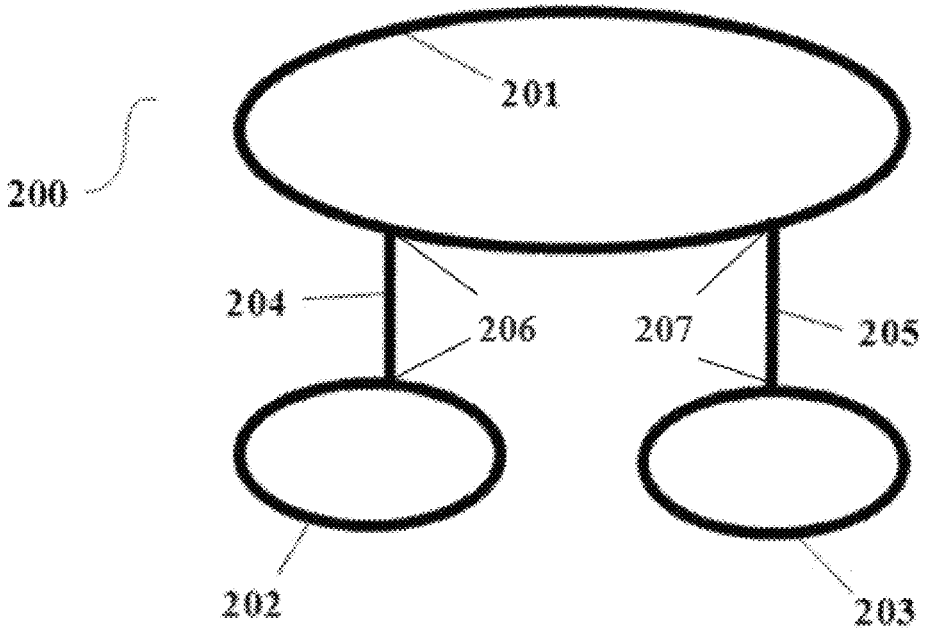

Referring to FIG. 2A and FIG. 2B, for example, buttocks support garment 200 comprises abdominal member 201, first thigh member 202, second thigh member 203, first support member 204, and second support member 205. FIG. 2A shows a top view of buttocks support garment 200, in which support members 204 and 205 are in the same plane as abdominal member 201. FIG. 2B shows a side view of buttocks support garment 200, in which support members 204 and 205 are perpendicular to the plane in which abdominal member 201 is located, as in use. As shown here, support member 204 is attached to thigh member 202 and to abdominal member 201. Support member 205 is attached to thigh member 203 and to abdominal member 201. The position on abdominal member 201 at which support member 204 is attached is located approximately 30° from the position on abdominal member 201 at which support member 205 is attached, although other distances are also envisioned.

Figure 3A:
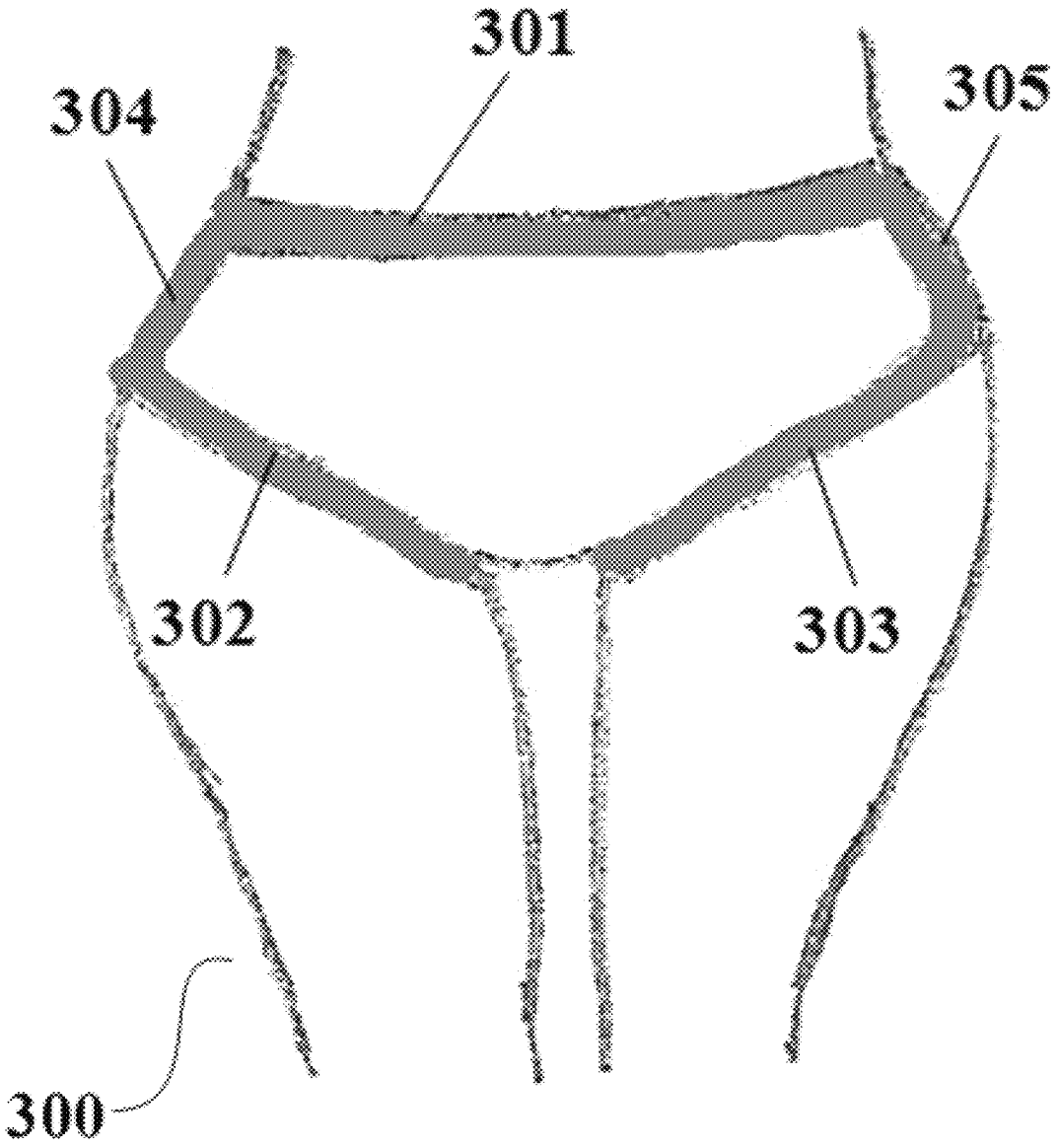
FIG. 3A and FIG. 3B show representative images of a buttocks support device in use. A front view (3A) and a back view (3B) are shown.
Figure 3B:
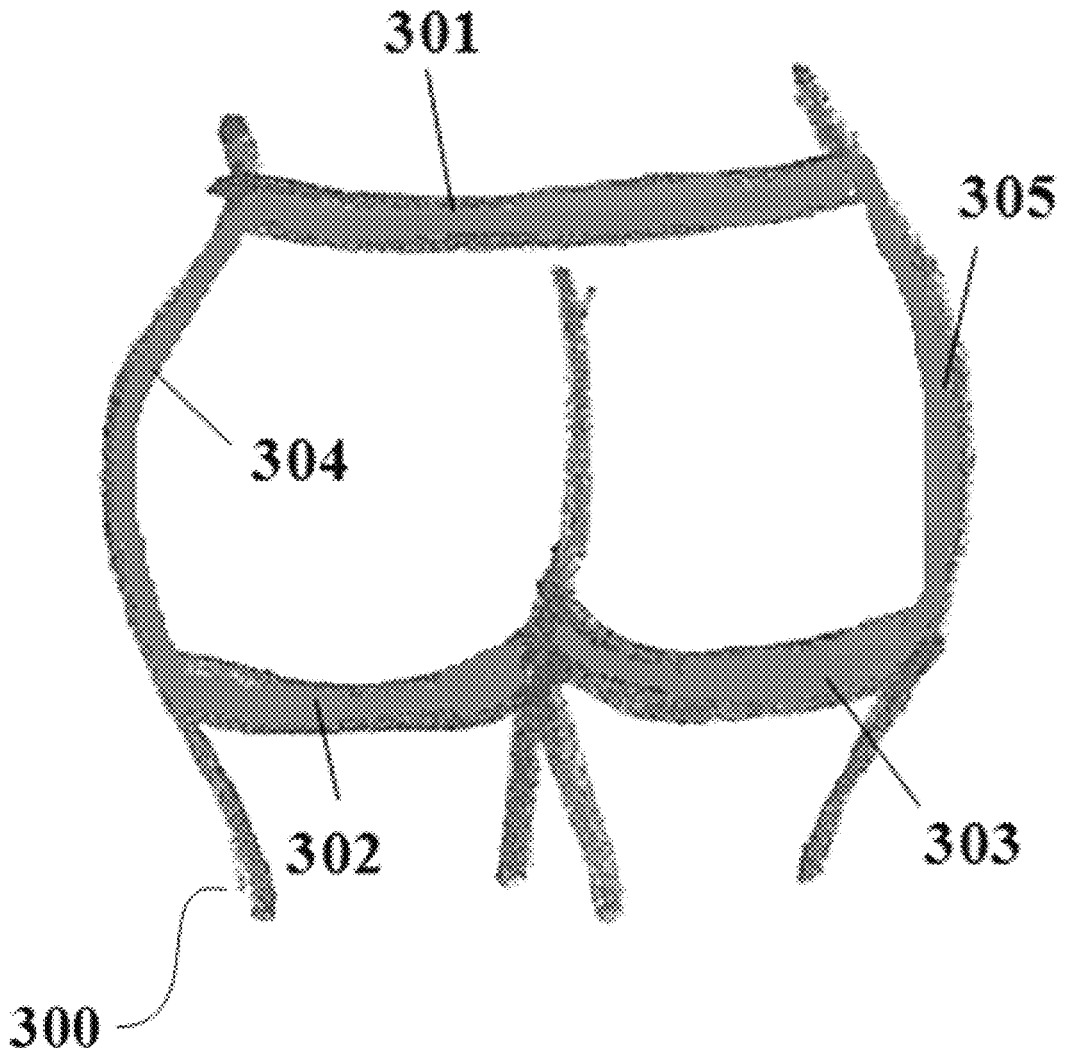

Referring to FIG. 3A and FIG. 3B, for example, buttocks support garment 300 is shown on a human form, such as being worn by a subject, and comprises abdominal member 301, first thigh member 302, second thigh member 303, first support member 304, and second support member 305. FIG. 3A shows a front view of buttocks support garment 300. FIG. 2B shows a back view of buttocks support garment 300. As shown here, support member 304 is attached to thigh member 302 and to abdominal member 301. Support member 305 is attached to thigh member 303 and to abdominal member 301. The position on abdominal member 301 at which support member 304 is attached is located approximately 180° from the position on abdominal member 301 at which support member 305 is attached, although other distances are also envisioned. Abdominal member 301 and support members 304 and 305 cooperate to pull thigh members 302 and 303 upwards, thereby lifting the buttocks of the wearer.

Figure 4A:
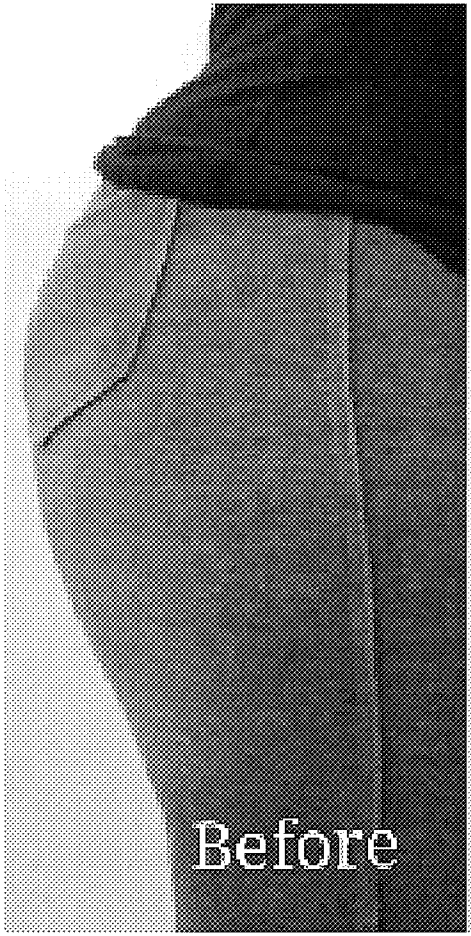
FIG. 4A and FIG. 4B show representative images of a buttocks without (4A) and with (4B) a buttocks support device in use.
Figure 4B:
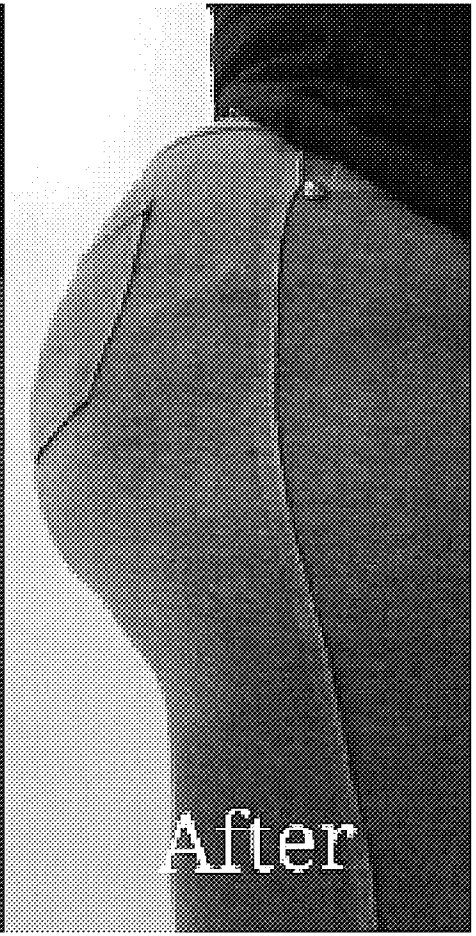

Referring to FIG. 4A (before) and FIG. 4B (after), the buttocks support garment lifts the buttocks of the wearer. As shown here, the buttocks support garment cannot be seen through clothing. Without wishing to be bound by theory, this results in a natural-looking, lifted buttocks.

A buttocks support garment of the present disclosure comprises the components disclosed herein, and referred to as separate members, for example, as an abdominal member, support members, and thigh members. One of skill in the art can readily understand that such members may be provided as separate members that are then physically attached to one another, or a buttocks support garment may be a unitary garment, manufactured as one piece, wherein the abdominal member, support members, and thigh members are arranged as described herein.

In an aspect, support members may be attached to an abdominal member or to a thigh member by a seam, which may be heat sealed, sewn, or constructed using other methods known for forming a seam. In an aspect, support members may be attached to an abdominal member or to a thigh member by an attachment member. In an aspect, support members may be attached to an abdominal member or to a thigh member by glue. In an aspect, support members may be attached to an abdominal member or to a thigh member by stitching. In an aspect, attached is via molding.

In various aspects, the buttocks support garment comprises a plurality of pairs of support members. For example, in an aspect, a buttocks support garment further comprises a second pair of support members comprising a first support member and a second support member, wherein each support member comprises a first end opposing a second end, and wherein the first support member is substantially parallel to the second support member.

In an aspect, the abdominal member, each thigh member, and each support member comprises a flexible material. Examples of flexible materials include, but are not limited to, elastic, Spandex, Lycra, and nylon. Thus, in various aspects, the abdominal member, each thigh member, and each support member comprise elastic. In an aspect, the abdominal member, each thigh member, and each support member comprise spandex. In an aspect, the abdominal member, each thigh member, and each support member comprise nylon.

In an aspect, the abdominal member, each thigh member, and each support member comprise a nonflexible material.

1. Abdominal Member

In an aspect, a disclosed buttocks support garment comprises an abdominal member adapted to encircle a portion of a person's abdomen. Without wishing to be bound by theory, the abdominal member is designed to ride on the waist and/or hips of a person. Thus, in various aspects, the abdominal member is adapted to encircle a person's waist. In an aspect, an abdominal member is adapted to encircle a person's hips. An abdominal member may be wide or narrow in width. An abdominal member may serve to provide a compression action on the waist or hips to make the waist or hips appear smaller. In an aspect, an abdominal member may provide no compression action on the waist or hips. In an aspect, an abdominal member may be sized to a particular length. An abdominal member may be a length that can be formed into a circle of desired circumference by use of fastening elements. For example, such an abdominal member functions like a belt that, with a buckle and appropriately place holes in the member, can be variable length circumference. Snaps or other fastening elements can be used to form the circumference of the abdominal member formed into a circle.

In an aspect, the abdominal member together with the support members is adapted to pull the thigh members upwards. In this way, the upward "pull" of the support members towards the abdominal member lifts the buttocks of the wearer when in use.

In an aspect, the abdominal member has an interior surface. In an aspect, each interior surface comprises a tacky material such as, for example, silicone.

In an aspect, the abdominal member has a width of from about 0.5 inches to about 5.5 inches. In an aspect, the abdominal member has a width of from about 0.5 inches to about 5.0 inches. In yet an aspect, the abdominal member has a width of from about 0.5 inches to about 4.5 inches. In an aspect, the abdominal member has a width of from about 0.5 inches to about 3.0 inches. In an aspect, the abdominal member has a width of from about 0.5 inches to about 2.5 inches. In yet an aspect, the abdominal member has a width of from about 0.5 inches to about 2.0 inches. In an aspect, the abdominal member has a width of from about 0.5 inches to about 1.5 inches. In an aspect, the abdominal member has a width of from about 0.5 inches to about 1.0 inch.

In an aspect, the abdominal member has a width of from about 1.0 inch to about 5.5 inches. In an aspect, the abdominal member has a width of from about 1.5 inches to about 5.5 inches. In yet an aspect, the abdominal member has a width of from about 2.0 inches to about 5.5 inches. In an aspect, the abdominal member has a width of from about 2.5 inches to about 5.5 inches. In yet an aspect, the abdominal member has a width of from about 3.0 inches to about 5.5 inches. In an aspect, the abdominal member has a width of from about 3.5 inches to about 5.5 inches. In an aspect, the abdominal member has a width of from about 4.0 inches to about 5.5 inches. In yet an aspect, the abdominal member has a width of from about 4.5 inches to about 5.5 inches. In an aspect, the abdominal member has a width of from about 5.0 inches to about 5.5 inches.

In various aspects, an abdominal member can be shaped into a circular form via, for example, an adjustment member, thereby allowing a person to adjust the abdominal member to the desired size. In this way, a person can fasten the abdominal member around a portion of his or her abdomen. In an aspect, an abdominal member may be sized to a particular length. An abdominal member may be a length that can be formed into a circle of desired circumference by use of one or more adjustment members. For example, such an abdominal member functions like a belt that, with a buckle and appropriately placed holes in the member (e.g., an adjustment member), can be variable length circumference. Snaps or other fastening elements can be used as adjustment members to form the circumference of the abdominal member formed into a circle. Thus, in various aspects, an abdominal member comprises an adjustment member. In an aspect, an adjustment member is selected from a clasp, a buckle, and hook-and-loop fasteners. In an aspect, an abdominal member is a belt.

In various aspects, the abdominal member can be formed of a stretchable material, thereby allowing the abdominal member to comfortably conform to a person's abdomen without bulge. In this way, a person can step into the abdominal member and slide the abdominal member up over his or her legs to the desired position on their abdomen. Alternatively, the abdominal member could be put on over a person's head, arms, and chest, similar to putting on a t-shirt, and placed at the desired position on the abdomen. Thus, in various aspects, the abdominal member comprises a flexible material. Examples of flexible materials include, but are not limited to, elastic, Spandex, Lycra, and nylon. Thus, in various aspects, the abdominal member comprises elastic. In yet an aspect, the abdominal member comprises spandex. In an aspect, the abdominal member comprises nylon.

In an aspect, an abdominal member comprises a nonflexible material.

In an aspect, an abdominal member comprises at least one attachment member. In an aspect, the abdominal member comprises a plurality of attachment members. In an aspect, an attachment member is selected from a strap, a loop, a hook, a clasp, a clip, and a snap, or a mixture thereof. In an aspect, an attachment member is configured to attach the abdominal member to a stocking.

2. Thigh Members

In an aspect, a disclosed buttocks support garment comprises two or more thigh members, described herein as a first thigh member and a second thigh member, wherein each thigh member is adapted to encircle a person's thigh. Without wishing to be bound by theory, each thigh member is designed to be placed on the thigh of a person, for example, the upper thigh. For lifting the buttocks, a thigh member is placed on the upper thigh and adjacent to the buttocks area of that leg.

In various aspects, a thigh member engages the top of a person's thigh at the juncture of the thigh and buttock. The abdominal member and the support members together exert an upward pull on the thigh members. In this way, a thigh member lifts and supports a buttock upward relative to the top of the person's thigh when in use.

In an aspect, a thigh member has an interior surface. In an aspect, an interior surface comprises a tacky material such as, for example, silicone.

In an aspect, a thigh member has a width of from about 0.25 inches to about 5.5 inches. In an aspect, a thigh member has a width of from about 0.25 inches to about 5.0 inches. In yet an aspect, a thigh member has a width of from about 0.25 inches to about 4.5 inches. In an aspect, a thigh member has a width of from about 0.25 inches to about 4.0 inches. In an aspect, a thigh member has a width of from about 0.25 inches to about 3.5 inches. In yet an aspect, a thigh member has a width of from about 0.25 inches to about 3.0 inches. In an aspect, a thigh member has a width of from about 0.25 inches to about 2.5 inches. In an aspect, a thigh member has a width of from about 0.25 inches to about 2.0 inches. In yet an aspect, a thigh member has a width of from about 0.25 inches to about 1.5 inches. In an aspect, a thigh member has a width of from about 0.25 inches to about 1.0 inch. In an aspect, a thigh member has a width of from about 0.25 inches to about 0.5 inches.

In an aspect, a thigh member has a width of from about 0.5 inches to about 5.5 inches. In an aspect, a thigh member has a width of from about 1.0 inch to about 5.5 inches. In yet an aspect, a thigh member has a width of from about 1.5 inches to about 5.5 inches. In an aspect, a thigh member has a width of from about 2.0 inches to about 5.5 inches. In an aspect, a thigh member has a width of from about 2.5 inches to about 5.5 inches. In yet an aspect, a thigh member has a width of from about 3.0 inches to about 5.5 inches. In an aspect, a thigh member has a width of from about 3.5 inches to about 5.5 inches. In an aspect, a thigh member has a width of from about 4.0 inches to about 5.5 inches. In yet an aspect, a thigh member has a width of from about 4.5 inches to about 5.5 inches. In an aspect, a thigh member has a width of from about 5.0 inches to about 5.5 inches.

In various aspects, like an abdominal member, a thigh member can be shaped into a circular form via, for example, an adjustment member, thereby allowing a person to adjust a thigh member to the desired size. Thus, in various aspects, a thigh member comprises an adjustment member. In an aspect, the adjustment member is selected from a clasp, a buckle, and hook-and-loop fasteners. In an aspect, a thigh member is a belt.

In various aspects, a thigh member can be formed of a stretchable material, thereby allowing the thigh members to comfortably conform to a person's thigh without bulge. In an aspect, a thigh member comprises a flexible material. Examples of flexible materials include, but are not limited to, elastic, Spandex, Lycra, and nylon. Thus, in various aspects, a thigh member comprises elastic. In yet an aspect, a thigh member comprises spandex. In an aspect, a thigh member comprises nylon.

In an aspect, a thigh member comprises a nonflexible material.

In an aspect, a thigh member comprises an attachment member. In an aspect, the attachment member is selected from a strap, a loop, a hook, a clasp, a clip, and a snap, or a mixture thereof. In yet an aspect, the attachment member is configured to attach a thigh member to a stocking.

3. Support Members

In an aspect, a disclosed buttocks support garment comprises a first support member comprising a first end attached to a first thigh member and an opposed second end attached to a first location on an abdominal member, and a second support member comprising a first end attached to a second thigh member and an opposed second end attached to a second location on the abdominal member, wherein, in use, the first support member is substantially parallel to the second support member.

In an aspect, a support member together with an abdominal member is adapted to pull a thigh member upwards. Specifically, a support member effectively transfer the tension applied by a thigh member to a support member and an abdominal member. In this way, the upward "pull" of a support member towards an abdominal member lifts a buttock of the wearer when in use.

In an aspect, a support member has a width of from about 0.25 inches to about 5.5 inches. In an aspect, a support member has a width of from about 0.25 inches to about 5.0 inches. In yet an aspect, a support member has a width of from about 0.25 inches to about 4.5 inches. In an aspect, a support member has a width of from about 0.25 inches to about 4.0 inches. In an aspect, a support member has a width of from about 0.25 inches to about 3.5 inches. In yet an aspect, a support member has a width of from about 0.25 inches to about 3.0 inches. In an aspect, a support member has a width of from about 0.25 inches to about 2.5 inches. In an aspect, a support member has a width of from about 0.25 inches to about 2.0 inches. In yet an aspect, a support member has a width of from about 0.25 inches to about 1.5 inches. In an aspect, a support member has a width of from about 0.25 inches to about 1.0 inch. In an aspect, a support member has a width of from about 0.25 inches to about 0.5 inches.

In an aspect, a support member has a width of from about 0.5 inches to about 5.5 inches. In an aspect, a support member has a width of from about 1.0 inch to about 5.5 inches. In yet an aspect, a support member has a width of from about 1.5 inches to about 5.5 inches. In an aspect, a support member has a width of from about 2.0 inches to about 5.5 inches. In an aspect, a support member has a width of from about 2.5 inches to about 5.5 inches. In yet an aspect, a support member has a width of from about 3.0 inches to about 5.5 inches. In an aspect, a support member has a width of from about 3.5 inches to about 5.5 inches. In an aspect, a support member has a width of from about 4.0 inches to about 5.5 inches. In yet an aspect, a support member has a width of from about 4.5 inches to about 5.5 inches. In an aspect, a support member has a width of from about 5.0 inches to about 5.5 inches.

In various aspects, a support member can be formed of a stretchable material, thereby allowing a support member to exert an upward, tensioning pull on a thigh member. In an aspect, a support member comprises a flexible material. Examples of flexible materials include, but are not limited to, elastic, Spandex, Lycra, and nylon. Thus, in various aspects, a support member comprises elastic. In yet an aspect, a support member comprises spandex. In an aspect, a support member comprises nylon.

In an aspect, a support member comprises a nonflexible material.

In various aspects, the strength of the upward pull exerted by a support member can be adjusted via, for example, an adjustment member. Thus, in various aspects, a support member comprises an adjustment member. In an aspect, the adjustment member is selected from a clasp, a buckle, and hook-and-loop fasteners.

In an aspect, the first attachment location on the abdominal member is from about 30° to about 180° apart from the second attachment location on the abdominal member. In an aspect, the first attachment location is from about 30° to about 160° apart from the second attachment location. In yet an aspect, the first attachment location is from about 30° to about 140° apart from the second attachment location. In an aspect, the first attachment location is from about 30° to about 120° apart from the second attachment location. In an aspect, the first attachment location is from about 30° to about 100° apart from the second attachment location. In yet an aspect, the first attachment location is from about 30° to about 80° apart from the second attachment location. In an aspect, the first attachment location is from about 30° to about 60° apart from the second attachment location. In an aspect, the first attachment location is from about 50° to about 180° apart from the second attachment location. In an aspect, the first attachment location is from about 70° to about 180° apart from the second attachment location. In an aspect, the first attachment location is from about 90° to about 180° apart from the second attachment location. In an aspect, the first attachment location is from about 110° to about 180° apart from the second attachment location. In yet an aspect, the first attachment location is from about 130° to about 180° apart from the second attachment location. In an aspect, the first attachment location is from about 150° to about 180° apart from the second attachment location.

In an aspect, the first attachment location on the abdominal member is about 180° from the second attachment location on the abdominal member. In an aspect, the first attachment location is about 160° from the second attachment location. In yet an aspect, the first attachment location is about 140° from the second attachment location. In an aspect, the first attachment location is about 120° from the second attachment location. In an aspect, the first attachment location is about 100° from the second attachment location. In yet an aspect, the first attachment location is about 80° from the second attachment location. In an aspect, the first attachment location is about 60° from the second attachment location. In an aspect, the first attachment location is about 40° from the second attachment location. In yet an aspect, the first attachment location is about 30° from the second attachment location.

4. Undergarments

In various aspects, a disclosed buttock support garment can be incorporated into an undergarment such as, for example, a thong, a panty, a pair of underwear, a waist trainer, and a corset. It is also envisioned that the buttocks support garment can be incorporated into other clothing items such as, for example, a swimsuit, a bikini bottom, a swimtrunk, pantyhose, pants, capris, leggings, and shorts.

In an aspect, a buttocks support garment further comprises: (a) a fabric strip adapted to cover a person's crotch, wherein the fabric strip comprises a front edge connected to a first location on the abdominal member, a back edge connected to a second location on the abdominal member, wherein the first location is about 180° from the second location, and a pair of side edges comprising a first side edge and a second side edge; (b) a first front panel comprising a first top edge connected to the abdominal member, a first bottom edge connected to the first thigh member, a first inner side edge connected to the first side edge, and a first outer side edge connected to the first support member; and (c) a second front panel comprising a second top edge connected to the abdominal member, a second bottom edge connected to the second thigh member, a second inner side edge connected to the second side edge, and a second outer side edge connected to the second support member, thereby forming a thong.

In an aspect, a buttocks support garment further comprises: (a) a first rear panel comprising a first top edge connected to the abdominal member, a first bottom edge connected to the first thigh member, a first inner side edge connected to the first side edge, and a first outer side edge connected to the first support member; and (b) a second rear panel comprising a second top edge connected to the abdominal member, a second bottom edge connected to the second thigh member, a second inner side edge connected to the second side edge, and a second outer side edge connected to the second support member, thereby forming a pair of underwear.

In an aspect, a buttocks support garment further comprises a corset comprising: (a) an inner layer and an outer layer, wherein each layer has a first edge opposing a second edge, and wherein the inner and outer layer are joined together, thereby forming at least one cavity between the layers; (b) at least one reinforcing strip positioned longitudinally in the cavity; (c) a plurality of first engagement members aligned longitudinally with respect to each other, wherein the first engagement members are connected to the inner and/or the outer layer; and (d) a plurality of second engagement members aligned longitudinally with respect to each other, wherein the second engagement members are connected to the inner and/or the outer layer, and wherein the second engagement members are configured to engage with the first engagement members, thereby forming a corset.

In an aspect, a layer is shaped into a circular form.

In an aspect, a layer is attached to an abdominal member. In an aspect, attached is via a seam. In yet an aspect, attached is via an attachment member. In an aspect, attached is via glue. In an aspect, attached is via stitching. In yet an aspect, attached is via molding.

In an aspect, the inner layer and the outer layer are a single piece of material. In an aspect, the inner layer and the outer layer are different pieces of material.

In an aspect, the inner and/or the outer layer comprise a flexible material. In an aspect, the inner layer comprises a flexible material. In yet an aspect, the outer layer comprises a flexible material. In an aspect, the inner and the outer layer comprise a flexible material. Examples of flexible materials include, but are not limited to, elastic, Spandex, Lycra, and nylon. Thus, in various aspects, the inner and/or the outer layer comprise elastic. In an aspect, the inner and/or the outer layer comprise spandex. In an aspect, the inner and/or the outer layer comprise nylon.

In an aspect, the inner and/or the outer layer comprise a nonflexible material.

In an aspect, a single cavity is formed between the two layers. In an aspect, a plurality of cavities is formed between the two layers.

In an aspect, a reinforcing strip is flexible. In an aspect, a reinforcing strip is rigid. In yet an aspect, a reinforcing strip comprises plastic and/or rubber.

In an aspect, a reinforcing strip is of from about 0.25 inches to 0.75 inches wide. In an aspect, a reinforcing strip is of from about 0.25 inches to 0.65 inches wide. In yet an aspect, a reinforcing strip is of from about 0.25 inches to 0.55 inches wide. In an aspect, a reinforcing strip is of from about 0.25 inches to 0.45 inches wide. In an aspect, a reinforcing strip is of from about 0.25 inches to 0.35 inches wide. In yet an aspect, a reinforcing strip is of from about 0.25 inches to 0.75 inches wide. In an aspect, a reinforcing strip is of from about 0.35 inches to 0.75 inches wide. In an aspect, a reinforcing strip is of from about 0.45 inches to 0.75 inches wide. In yet an aspect, a reinforcing strip is of from about 0.55 inches to 0.75 inches wide. In an aspect, a reinforcing strip is of from about 0.65 inches to 0.75 inches wide.

In an aspect, more than one reinforcing strip is present. In an aspect, each reinforcing strip is positioned in the same cavity. In yet an aspect, each reinforcing strip is positioned in a different cavity.

In an aspect, each reinforcing strip is spaced from about 0.25 inches to about 1.0 inch apart from each other. In an aspect, each reinforcing strip is spaced from about 0.25 inches to about 0.75 inches apart from each other. In yet an aspect, each reinforcing strip is spaced from about 0.25 inches to about 0.50 inches apart from each other. In an aspect, each reinforcing strip is spaced from about 0.50 inches to about 1.0 inch apart from each other. In an aspect, each reinforcing strip is spaced from about 0.75 inches to about 1.0 inch apart from each other.

In an aspect, a reinforcing strip is connected to the inner layer and/or the outer layer. In an aspect, a reinforcing strip is not connected to the inner layer or the outer layer.

C. Methods of Making a Buttocks Support Garment

In an aspect, disclosed are methods of making a buttocks support garment, the method comprising: (a) attaching a first end of a first support member and a first thigh member, wherein the first thigh member is adapted to encircle a person's thigh; (b) attaching a first end of a second support member and a second thigh member, wherein the second thigh member is adapted to encircle a person's thigh; (c) attaching a second end of the first support member to a first location on an abdominal member, wherein the abdominal member is adapted to encircle a person's abdomen; and (d) attaching a second end of the second support member to a second location on the abdominal member, wherein, in use, the first support member is substantially parallel to the second support member, thereby making a buttocks support garment.

In an aspect, the first attachment location on the abdominal member is from about 30° to about 180° apart from the second attachment location on the abdominal member. In an aspect, the first attachment location is from about 30° to about 160° apart from the second attachment location. In yet an aspect, the first attachment location is from about 30° to about 140° apart from the second attachment location. In an aspect, the first attachment location is from about 30° to about 120° apart from the second attachment location. In an aspect, the first attachment location is from about 30° to about 100° apart from the second attachment location. In yet an aspect, the first attachment location is from about 30° to about 80° apart from the second attachment location. In an aspect, the first attachment location is from about 30° to about 60° apart from the second attachment location. In an aspect, the first attachment location is from about 50° to about 180° apart from the second attachment location. In yet an aspect, the first attachment location is from about 70° to about 180° apart from the second attachment location. In an aspect, the first attachment location is from about 90° to about 180° apart from the second attachment location. In an aspect, the first attachment location is from about 110° to about 180° apart from the second attachment location. In yet an aspect, the first attachment location is from about 130° to about 180° apart from the second attachment location. In an aspect, the first attachment location is from about 150° to about 180° apart from the second attachment location.

In an aspect, the first attachment location is about 180° from the second attachment location. In an aspect, the first attachment location is about 160° from the second attachment location. In yet an aspect, the first attachment location is about 140° from the second attachment location. In an aspect, the first attachment location is about 120° from the second attachment location. In an aspect, the first attachment location is about 100° from the second attachment location. In yet an aspect, the first attachment location is about 80° from the second attachment location. In an aspect, the first attachment location is about 60° from the second attachment location. In an aspect, the first attachment location is about 40° from the second attachment location. In yet an aspect, the first attachment location is about 30° from the second attachment location.

A method of making a buttocks support garment may comprise making a unitary garment by providing a mold having a shape essentially like FIG. 1A; adding an elastomeric or stretchy material to the mold; curing of the material or allowing the material to assume the shape of the mold to form a unitary buttocks support garment, and removing a unitary buttocks support garment from the mold. Finishing steps may be done to the buttocks support garment, such as removing excess material or stamping lettering on the buttocks support garment.

A unitary buttocks support garment may be made by weaving or knitting a one piece unitary buttocks support garment using fibers that provide a desired effect.

D. Methods of Lifting a Wearer's Buttocks

In an aspect, disclosed are methods of lifting a person's buttocks, the method comprising wearing a buttocks support garment comprising: (a) an abdominal member adapted to encircle a portion of a person's abdomen; (b) a first thigh member and a second thigh member, wherein each thigh member is adapted to encircle a person's thigh; (c) a first support member comprising a first end attached to the first thigh member and an opposed second end attached to a first location on the abdominal member; and (d) a second support member comprising a second end attached to the second thigh member and an opposed second end attached to a second location on the abdominal member, wherein the first support member is substantially parallel to the second support member, thereby lifting the person's buttocks.

Without wishing to be bound by theory, it is understood that the abdominal member together with the support members is adapted to pull the thigh members upwards, effectively transferring the tension applied by the thigh members to the support members and abdominal member. In this way, the upward 'pull' of the support members towards the abdominal member lifts the buttocks of the wearer when in use.

E. Kits

In an aspect, disclosed are kits comprising kit comprising a buttocks support garment comprising: (a) an abdominal member adapted to encircle a portion of a person's abdomen; (b) a first thigh member and a second thigh member, wherein each thigh member is adapted to encircle a person's thigh; (c) a first support member comprising a first end attached to the first thigh member and an opposed second end attached to a first location on the abdominal member; and (d) a second support member comprising a second end attached to the second thigh member and an opposed second end attached to a second location on the abdominal member, wherein the first support member is substantially parallel to the second support member, and one or more of: (a) instructions for attaching an abdominal member and a support member; (b) instructions for attaching a thigh member and a support member; or (c) instructions for lifting a buttocks.

In an aspect, disclosed are kits comprising: (a) an abdominal member adapted to encircle a person's abdomen; (b) a first thigh member and a second thigh member, wherein each thigh member is adapted to encircle a person's thigh; (c) a first support member and a second support member, wherein each support member comprises a first end and an opposed second end, and one or more of: (d) instructions for attaching an abdominal member and a support member; (e) instructions for attaching a thigh member and a support member; or (0 instructions for lifting a buttocks.

It will be apparent to those skilled in the art that various modifications and variations can be made in the present disclosure without departing from the scope or spirit of the disclosure. Other aspects of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A buttocks support garment comprising:

(a) an abdominal member adapted to encircle a portion of a person's abdomen;

(b) a first thigh member and a separate second thigh member, wherein each thigh member is adapted to encircle a thigh of the person; and (c) connecting members attached to the abdominal member, wherein all of the connecting members consist of:

a first support member comprising a first end attached perpendicularly to the first thigh member and an opposed second end attached perpendicularly to the abdominal member; and a second support member comprising a second end attached perpendicularly to the second thigh member and an opposed second end attached perpendicularly to the abdominal member, wherein each support member has a length such that the first and second thigh members are adapted to be located on an upper thigh of the person and configured to be in contact with a buttock of the person during use; and wherein the abdominal member together with each support member is adapted to pull the first and second thigh members upwards.

2. The buttocks support garment of claim 1, wherein each support member comprises a flexible material.

3. The buttocks support garment of claim 1, wherein the abdominal member has a width of from 0.5 inches to 5.5 inches.

4. The buttocks support garment of claim 1, wherein the abdominal member has a width from 0.5 inches to 1.5 inches.

5. The buttocks support garment of claim 1, wherein the abdominal member has a width of from 3.0 inches to 5.5 inches.

6. The buttocks support garment of claim 1, wherein each thigh member has a width of from 0.25 inches to 5.5 inches.

7. The buttocks support garment of claim 1, wherein each support member has a width of from 0.25 inches to 1.5 inches.

8. The buttocks support garment of claim 1, wherein each support member has a width of from 0.25 inches to 1.0 inch.

9. The buttocks support garment of claim 1, wherein each support member is identical in width, length, and shape.

10. The buttocks support garment of claim 1, wherein each support member has a uniform width along each support member's individual entire length.

11. The buttocks support garment of claim 1, wherein attached is via a seam.

12. The buttocks support garment of claim 1, wherein the abdominal member configured to be formed into a circle that is adapted to encircle a portion of the person's abdomen via the use of one or more fastening elements.

13. The buttocks support garment of claim 12, wherein at least one of the fastening elements is hook-and-loop fasteners.

14. The buttocks support garment of claim 1, wherein each of the first and the second thigh members are configured to be formed into a circle that is adapted to encircle the thigh of the person via the use of a plurality of hook-and-loop fasteners.

15. The buttocks support garment of claim 1, wherein the buttocks support garment consists of the abdominal member, the first and second thigh members, and the connecting members.

16. A buttocks support garment comprising:

(a) an abdominal member adapted to encircle a portion of a person's abdomen;

(b) a first thigh member and a separate second thigh member, wherein each thigh member is adapted to encircle a thigh of the person;

(c) connecting members attached to the abdominal member, wherein all of the connecting members consist of:

a first support member comprising a first end attached perpendicularly to the first thigh member and an opposed second end attached perpendicularly to the abdominal member; and a second support member comprising a second end attached perpendicularly to the second thigh member and an opposed second end attached perpendicularly to the abdominal member; and (d) a waist trainer or corset attached to the abdominal member, wherein each support member has a length such that the first and second thigh members are adapted to be located on an upper thigh of the person and configured to be in contact with a buttock of the person during use; and wherein the abdominal member together with each support member is adapted to pull the first and second thigh members upwards.

17. The buttocks support garment of claim 16, wherein each thigh member has a width of from 0.25 inches to 5.5 inches, and wherein each support member has a width of from 0.25 inches to 1.5 inches.

18. The buttocks support garment of claim 16, wherein the abdominal member configured to be formed into a circle that is adapted to encircle a portion of the person's abdomen via the use of one or more fastening elements.

19. The buttocks support garment of claim 16, wherein each of the first and the second thigh members are configured to be formed into a circle that is adapted to encircle the thigh of the person via the use of a plurality of hook-and-loop fasteners.

20. The buttocks support garment of claim 16, wherein the buttocks support garment consists of the abdominal member, the first and second thigh members, the connecting members, and the waist trainer or corset.

* * * * *